US005762396A

United States Patent [19]

Barile

[11] Patent Number: 5,762,396

[45] Date of Patent: Jun. 9, 1998

[54] STACKABLE CHAIR AND ASSOCIATED STACKING SUPPORT ASSEMBLY

[75] Inventor: Peter Barile, Hamblen County, Tenn.

[73] Assignee: Shelby Williams Industries, Inc., Morristown, Tenn.

[21] Appl. No.: 356,890

[22] Filed: Dec. 15, 1994

[51] Int. Cl.[6] ..... A47C 3/04

[52] U.S. Cl. ..... 297/239

[58] Field of Search ..... 297/239, 257

[56] References Cited

U.S. PATENT DOCUMENTS

| | | | |
|---|---|---|---|
| 1,758,826 | 5/1930 | Dellert | 297/239 |
| 3,203,731 | 8/1965 | Krueger | 297/239 |
| 3,236,559 | 2/1966 | Kaufman | 297/239 |
| 3,316,016 | 4/1967 | Petersen | 297/239 |
| 4,057,288 | 11/1977 | Schwartz et al. | 297/239 |

FOREIGN PATENT DOCUMENTS

| | | | |
|---|---|---|---|
| 454332 | 9/1936 | United Kingdom | 297/239 |
| 465146 | 5/1937 | United Kingdom | 297/239 |
| 510570 | 8/1939 | United Kingdom | 297/239 |
| 605035 | 7/1948 | United Kingdom | 297/239 |

*Primary Examiner*—Peter M. Cuomo
*Assistant Examiner*—David E. Allred
*Attorney, Agent, or Firm*—Pitts & Brittian, P.C.

[57] ABSTRACT

A stackable chair (10) and an associated stacking support assembly. The chair (10) includes a frame (22) defining at least first and second front leg members (14, 16) and first and second rear leg members (18, 20), with a seat portion (12) being supported on the frame (22). The chair (10) includes a stacking support assembly for facilitating the stacking of the chair (10) upon another chair (10). The stacking support assembly includes first and second lower support bars (26, 28) mounted on opposite sides of the frame (22) below the seat portion (12), and includes first and second upper support bars (30, 32) mounted on opposite sides of the frame (22) below the seat portion (12) and above, and selectively spaced from, the first and second lower support bars (26, 28), respectively. When the chairs (10) of the present invention are stacked, the first and second lower support bars (26, 28) of one chair (10) engage, and support such chair upon, the first and second upper support bars (30, 32), respectively, of the chair (10) below.

19 Claims, 3 Drawing Sheets

STACKABLE CHAIR AND ASSOCIATED STACKING SUPPORT ASSEMBLY

DESCRIPTION

1. Technical Field

This invention relates to a stackable chair and an associated stacking support assembly. In this particular invention the chair has a stacking support assembly including support bars which support the stacked disposition of the chairs.

2. Background Art

Chairs which can be stacked upon one another to facilitate their storage are known in the art. However, when typical chairs are stacked the lower surface of the seat bottom of one chair is supported on the seat cushion of the chair below it. Whereas seat cushions generally will serve to support chairs stacked thereon, the flexibility of the cushion can undermine the stability of the resulting stack of chairs such that relatively few chairs can be safely stacked. Further, the leg members of most stackable chairs are secured to the lower surface of the seat portion, and the lower surface of such chairs can define other irregular features. As a result, it is common for impressions of the legs and/or other irregular features of the lower surface of the seat bottoms to remain in the seat cushions of the chairs when they are un-stacked. These impressions are aesthetically undesirable, and over time damage can result, requiring replacement of the cushion or replacement of the chair.

Therefore, it is an object of the present invention to provide a stackable chair and associated stacking support assembly which facilitate the stable stacking of such chair.

It is another object of the present invention to provide a stackable chair and associated stacking support assembly which allow a greater number of chairs to be stacked for storage without the stack becoming unstable.

Yet another object of the present invention is to provide a stackable chair and associated stacking support assembly which obviate the problem of seat bottom impressions being left in the seat cushions when chairs are un-stacked.

Still another object of the present invention is to provide a stackable chairs and an associated stacking support assembly which are easy and inexpensive to manufacture and maintain.

SUMMARY OF THE INVENTION

The present invention provides a stackable chair and an associated stacking support assembly. The chair includes a frame defining at least first and second front leg members and first and second rear leg members, with a seat portion being supported on the frame. The chair also includes a stacking support assembly for facilitating the stacking of the chair upon another such chair. The stacking support assembly includes first and second lower support bars mounted on opposite sides of the frame below the seat portion, and includes first and second upper support bars mounted on opposite sides of the frame below the seat portion and above, and selectively spaced from, the first and second lower support bars, respectively. When the chairs of the present invention are stacked, the first and second lower support bars of one chair engage, and support such chair upon, the first and second upper support bars, respectively, of the chair below. Accordingly, each stacked chair is supported on the upper support bars of the chair below rather than on the seat cushion of the chair below allowing the chairs to be stacked without damage to the seat cushions thereof.

BRIEF DESCRIPTION OF THE DRAWINGS

The above mentioned features of the invention will be more clearly understood from the following detailed description of the invention read together with the drawings in which.

BEST MODE FOR CARRYING OUT THE INVENTION

Figure 1:
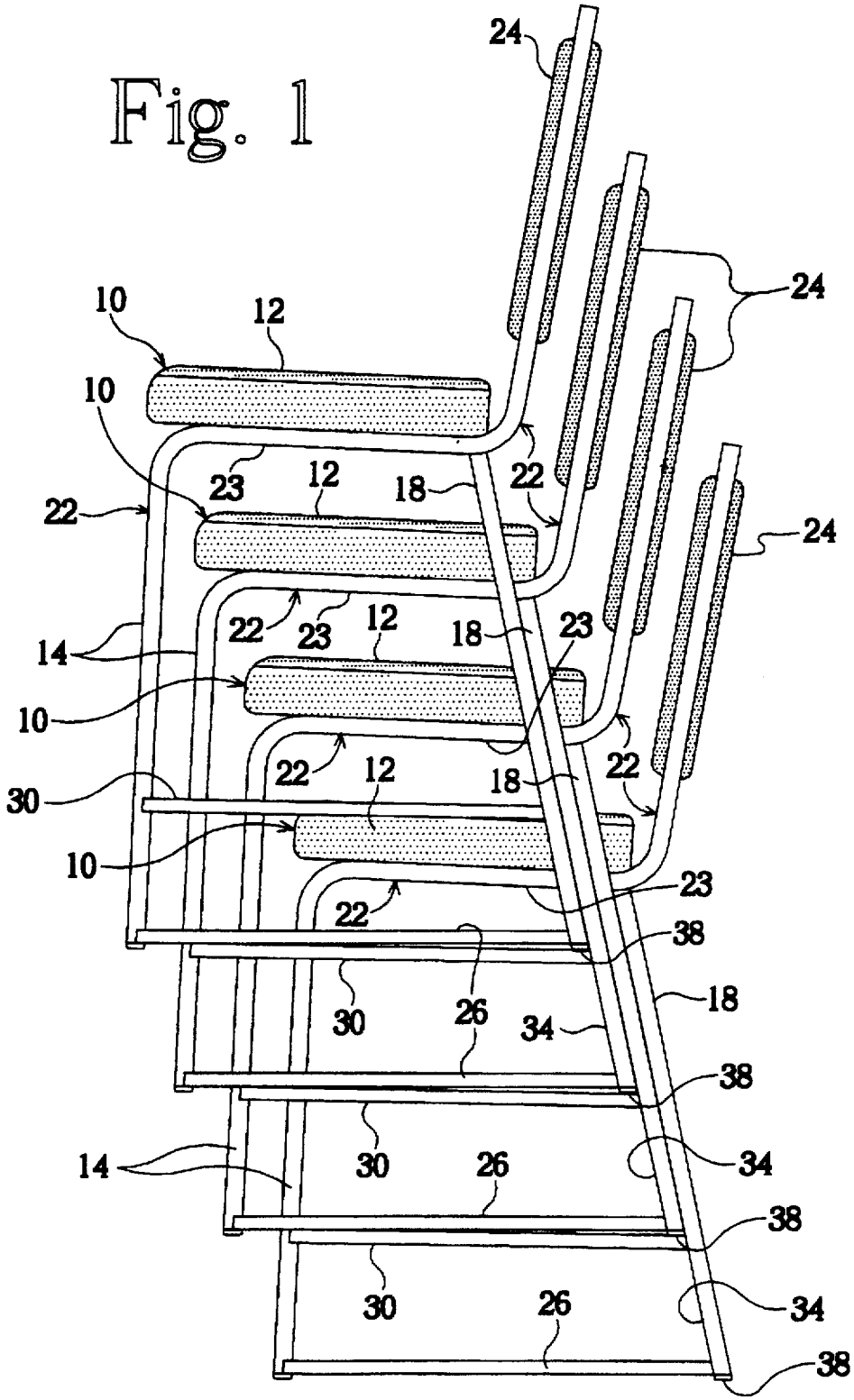
FIG. 1 illustrates a side elevation view of a plurality of stackable chairs of the present invention, in a stacked disposition.
Figure 2:
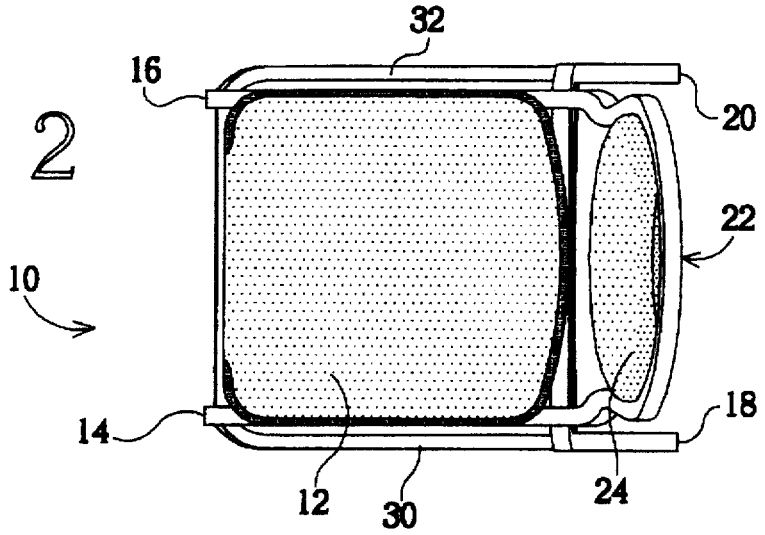
FIG. 2 illustrates a top plan view of a stackable chair of the present invention.

Stackable chairs incorporating various features of the chair of the present invention are illustrated generally at 10 in the Figures. For purposes of the discussion herein the term "chair" is intended to include chairs, benches and stools, as well as other seating structures having legs of various lengths.

Each of the chairs 10 includes a seat portion 12 which is supported on at least two front leg members 14 and 16 and at least two rear leg members 18 and 20. In the preferred illustrated embodiment the leg members 14, 16, 18 and 20 are incorporated into a chair frame 22 which supports not only the seat portion 12, but a back rest portion 24. However, it is contemplated that certain embodiments of the chair of the present invention may not be provided with a back rest portion 24. It will be noted that the frame 22 also defines first and second leg connecting members 23 and 25, respectively, which extend between the proximal end portions of the front and rear leg members and support the seat portion 12.

Each chair 10 includes a stacking support assembly to facilitate the stacking of a plurality of chairs 10. The stacking support assembly includes first and second lower support bars 26 and 28, respectively, and first and second upper support bars 30 and 32, respectively, with the upper support bars 30 and 32 being disposed above, and selectively spaced from, the lower support bars 26 and 28. In this regard, in the preferred embodiment the lower support bar 26 extends between the front leg member 14 and the rear leg member 18, and the lower support bar 28 extends between the front leg member 16 and the rear leg member 20. Similarly, the upper support bar 30 extends between the front leg member 14 and the rear leg member 18, and the upper support bar 32 extends between the front leg member 16 and the rear leg member 20. Whereas it is contemplated that the support bars 26, 28, 30 and 32 can be otherwise secured to the frame 22, the securing of the bars at their opposite ends to the leg members 14, 16, 18 and 20 not only allows the bars to be firmly and durably supported on the frame, but allows the bars 26, 28, 30 and 32 to serve as brace members which brace the leg members 14, 16, 18 and 20.

Figure 5:
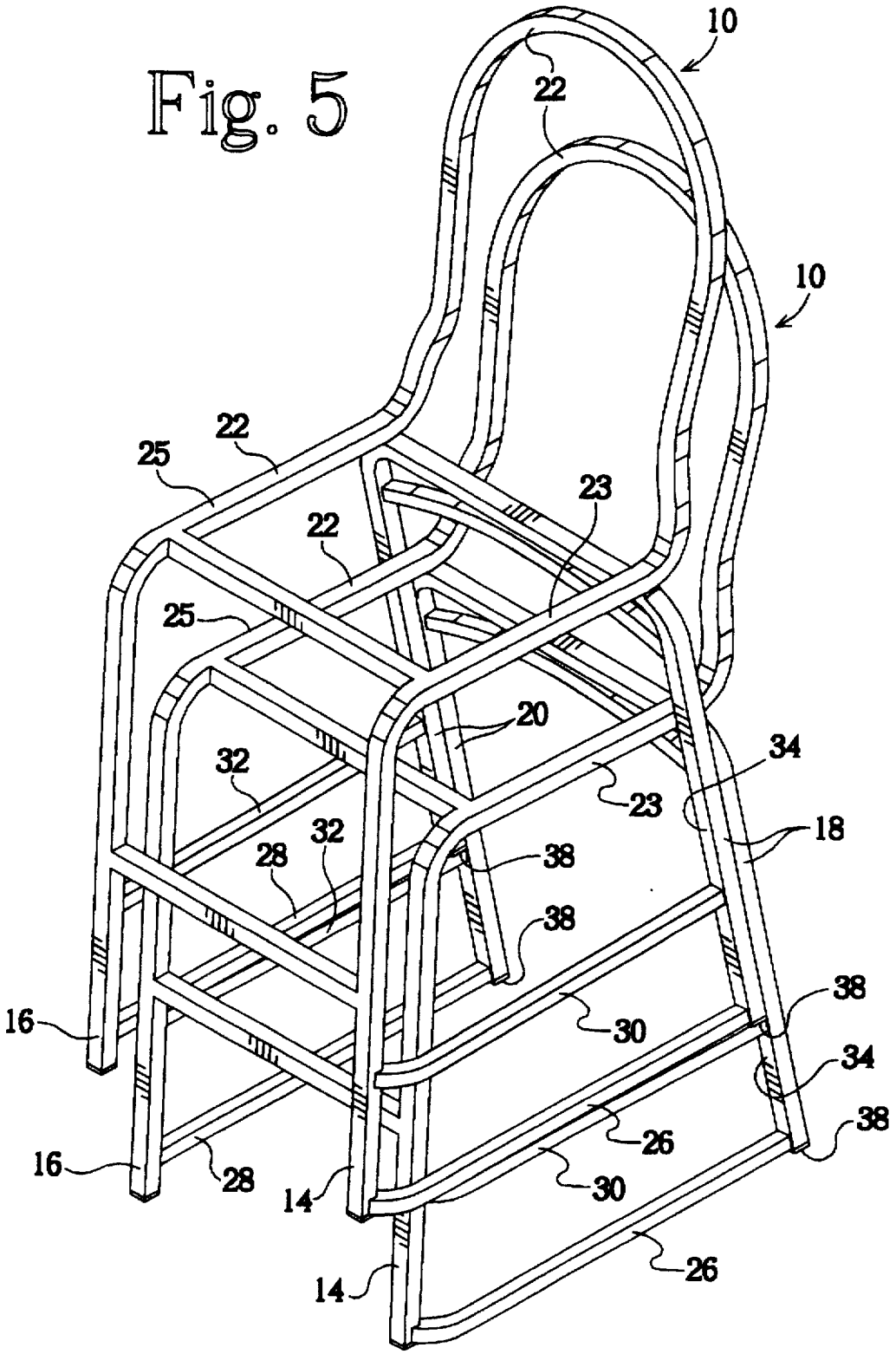
FIG. 5 illustrates a perspective view of two stacked chair frames of the stackable chairs of the present invention.

As best illustrated in FIGS. 1 and 5, when the chair 10 are in a stacked disposition the lower support bars 26 and 28 of each stacked chair 10 engage, and are supported on, the upper support bars 30 and 32, respectively, of the chair 10 below it. As a consequence of the spaced disposition of the upper support bar 30 and lower support bar 26, and the upper support bar 32 and the lower support bar 28, each stacked chair 10 is supported on the upper support bars 30 and 32 of the chair below it rather than being supported on the seat portion of the chair below. Accordingly, the upper support bars 30 and 32 provide rigid support for the chair 10 supported thereon, thereby making the resulting stack of chairs 10 more stable than a stack produced by stacking typical prior art chairs. Further, repetitive stacking of the chairs 10 does not damage the seat portions 12 of the chairs 10, and upon the un-stacking of the chairs 10 no unsightly chair bottom impressions are left in the seat portions 12.

Figure 3:
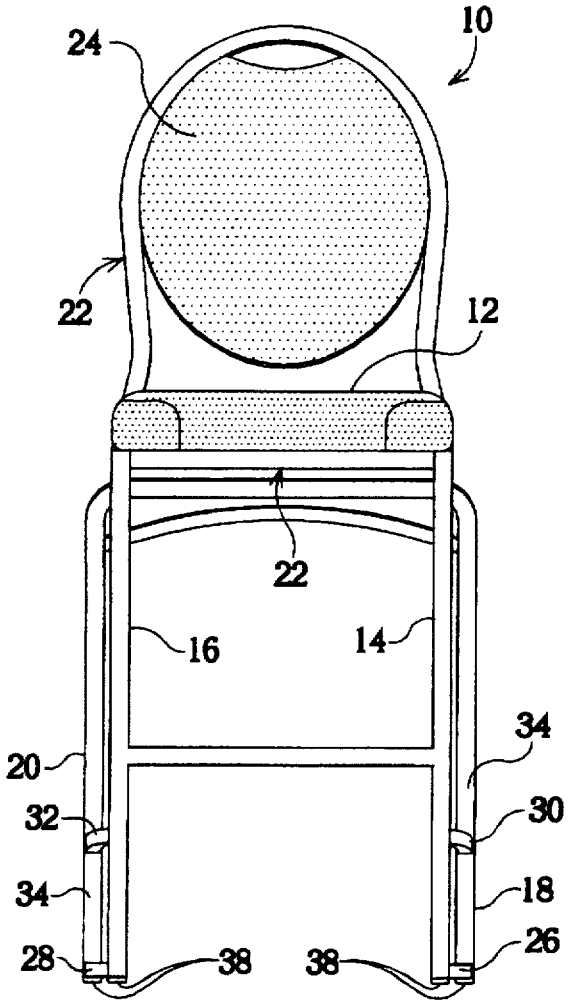
FIG. 3 illustrates a front elevation view of a stackable chair of the present invention.

In the preferred illustrated embodiment of the chair 10, the supportive engagement of the lower support bars 26 and 28 with the upper support bars 30 and 32 is facilitated by a disparity in the spacing of the front leg members 14 and 16 relative to the spacing of the rear leg members 18 and 20. As best illustrated in FIG. 3, the rear leg members 18 and 20 are more widely spaced than the front leg members 14 and 16, such that the front leg members 14 and 16 can be received between the rear leg members 18 and 20 of another chair 10. Further, the lower support bars 26 and 28 extend outwardly from the forward surfaces 34 of the rear leg members 18 and 20, respectively, and at a point proximate the front leg members 14 and 16, respectively, are directed inwardly to engage the front leg members 14 and 16, respectively. Similarly, the upper support bars 30 and 32 extend outwardly from the forward surfaces 34 of the rear leg members 18 and 20, respectively, and at a point proximate the front leg members 14 and 16, respectively, are directed inwardly to engage the front leg members 14 and 16, respectively. As best illustrated in FIG. 5, this disparate spacing of the front and rear leg members and this particular disposition of the support bars 26, 28, 30 and 32, allows the lower support bars 26 and 28 of one chair 10 to be aligned directly above the upper support bars 30 and 32 of the chair 10 on which it is stacked thereby facilitating the stable stacking of the chairs 10.

Figure 4:
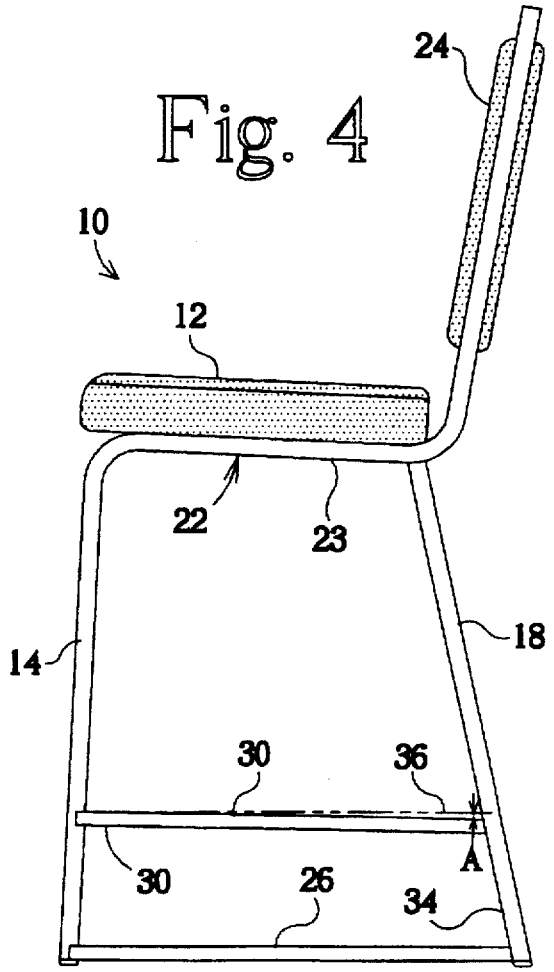
FIG. 4 illustrates a side elevation view of a stackable chair of the present invention.

It will also be noted that in the preferred illustrated embodiment of the chair 10 the upper support bars 30 and 32 angle downwardly from the front leg members 14 and 16, respectively, to the rear leg members 18 and 20, respectively. This angle is best illustrate in FIG. 4 by comparison with phantom line 36 which is substantially parallel to the floor or supporting surface on which the chair 10 would be supported; the angle being referenced at A in FIG. 4. As illustrated in FIG. 1, this angled disposition of the upper support bars 30 and 32 allows the feet 38 of the rear leg members 18 and 20 to engage and rest upon the rear portions of the upper support bars 30 and 32 while maintaining the stacked chairs 10 in a substantially level disposition. Whereas the value of the illustrated angle A is such that the stacked chairs 10 maintain substantially the same, level disposition of the bottom most chair 10 which engages the floor or supporting surface, it is anticipated that the angle A can be increased. Such increase in the value of angle A results in a rearward tilt of each stacked chair 10 relative to the chair 10 on which it is supported. This rearward tilt reduces the forward shift of the center of gravity of the stack of chairs as chairs 10 are added, thereby producing a more stable stack of chairs.

In light of the above it will be recognized that the present invention provides a stackable chair and an associated stacking support assembly having great advantages over the prior art. However, while a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A chair for supporting a second said chair in a stacked disposition, said chair comprising:

a frame defining at least first and second front leg members and first and second rear leg members, each said first and second front leg member and each said first and second rear leg member having a distal end for supporting said chair upon a supporting surface and a proximal end portion, said frame further defining first and second leg connecting members, said first leg connecting member extending between said proximal end portion of said first front leg member and said proximal end portion of said first rear leg member, and said second leg connecting member extending between said proximal end portion of said second front leg member and said proximal end portion of said second rear leg member;

a seat portion supported on said frame; and a stacking support assembly for facilitating the stacking of said second said chair upon said chair, said stacking support assembly including a first upper support bar engagable with said second said chair to support said second said chair in a stacked disposition, said first upper support bar being mounted on a first side of said frame below said first leg connecting member and above, and selectively spaced from, said distal end of said first front leg member and said distal end of said first rear leg member, said first upper support bar extending outwardly from a plane defined by said first front leg member and said first rear leg member, said stacking support assembly further including a second upper support bar engageable with said second said chair to support said second said chair in a stacked disposition, said second upper support bar being mounted on a second side of said frame below said second leg connecting member and above, and selectively spaced from, said distal end of said second front leg member and said distal end of said second rear leg member, said second upper support bar extending outwardly from a plane defined by said second front leg member and said second rear leg member, said stacking support assembly further including a first lower support bar mounted on said first side of said frame below said first upper support bar and includes a second lower support bar mounted on said second side of said frame below said second upper support bar, whereby said first and second lower support bars of said second said chair engage and support said second said chair upon said first and second upper support bars, respectively, of said chair when said second said chair is stacked upon said chair.

2. The chair of claim 1 wherein said first upper support bar is secured at a first end to said first front leg member and secured at a second end to said first rear leg member, and wherein said second upper support bar is secured at a first end to said second front leg member and secured at a second end to said second rear leg member.

3. The chair of claim 1 wherein said first upper support bar is secured at a first end to said first front leg member and secured at a second end to said first rear leg member, and said second upper support bar is secured at a first end to said second front leg member and secured at a second end to said second rear leg member, and wherein said first lower support bar is secured at a first end to said first front leg member and secured at a second end to said first rear leg member, and said second lower support bar is secured at a first end to said second front leg member and secured at a second end to said second rear leg member.

4. The chair of claim 3 wherein said first and second front leg members are space apart a first distance and said first and second rear leg members are space apart a second distance, said second distance being greater than said first distance whereby said first and second front leg members of said chair can be received between said first and second rear leg members of said second said chair to facilitated the stacking of said second said chair upon said chair.

5. The chair of claim 4 wherein said second end of said first upper support bar engages a forward surface of said first rear leg member, and said first upper support bar is directed inwardly proximate its first end to engage said first front leg member, and wherein said second end of said second upper support bar engages a forward surface of said second rear leg member, and said second upper support bar is directed inwardly proximate its first end to engage said second front leg member.

6. The chair of claim 5 wherein said second end of said first lower support bar engages a forward surface of said first rear leg member, and said first lower support bar is directed inwardly proximate its first end to engage said first front leg member, and wherein said second end of said second lower support bar engages a forward surface of said second rear leg member, and said second lower support bar is directed inwardly proximate its first end to engage said second front leg member.

7. The chair of claim 3 wherein said first upper support member is mounted on said frame such that said first upper support member angles downwardly from said first end of said first upper support member to said second end of said first upper support member, and wherein said second upper support member is mounted on said frame such that said second upper support member angles downwardly from said first end of said second upper support member to said second end of said second upper support member.

8. A chair for being stacked upon a second said chair, said chair comprising:

a frame defining at least first and second front leg members and first and second rear leg members, each said first and second front leg member and each said first and second rear leg member defining a proximal end portion, said frame further defining leg connecting means connecting said proximal end portion of said first front leg member to at least one of said first and second rear leg members, and connecting said proximal end portion of said second front leg member to at least one of said first and second rear leg members;

a seat portion supported on said frame; and a stacking support assembly for facilitating the stacking of said chair upon said second said chair, said stacking support assembly including a first lower support bar mounted on a first side of said frame below said leg connecting means and said seat portion, and a second lower support bar mounted on a second side of said frame below said leg connecting means and said seat portion, said stacking support assembly further including a first upper support bar mounted on said first side of said frame below said leg connecting means and said seat portion and above, and selectively spaced from, said first lower support bar, said first upper support bar extending outwardly from a plane defined by said first front leg member and said first rear leg member, said first lower support bar of said chair being engageable with said first upper support bar of said second said chair to support said chair upon said second said chair, said stacking support assembly further including a second upper support bar mounted on said second side of said frame below said leg connecting means and said seat portion and above, and selectively spaced from, said second lower support bar, said second upper support bar extending outwardly from a plane defined by said second front leg member and said second rear leg member, said second lower support bar of said chair being engageable with said second upper support bar of said second said chair to support said chair upon said second said chair, whereby said first and second lower support bars of said chair engage, and support said chair upon, said first and second upper support bars, respectively, of said second said chair when said chair is stacked upon said second said chair.

9. The chair of claim 8 wherein said first upper support bar is secured at a first end to said first front leg member and secured at a second end to said first rear leg member, and said second upper support bar is secured at a first end to said second front leg member and secured at a second end to said second rear leg member, and wherein said first lower support bar is secured at a first end to said first front leg member and secured at a second end to said first rear leg member, and said second lower support bar is secured at a first end to said second front leg member and secured at a second end to said second rear leg member.

10. The chair of claim 9 wherein said first and second front leg members are space apart a first distance and said first and second rear leg members are space apart a second distance, said second distance being greater than said first distance whereby said first and second front leg members of said second said chair can be received between said first and second rear leg members of said chair to facilitated the stacking of said chair upon said second said chair.

11. The chair of claim 10 wherein said second end of said first upper support bar engages a forward surface of said first rear leg member, and said first upper support bar is directed inwardly proximate its first end to engage said first front leg member, and wherein said second end of said second upper support bar engages a forward surface of said second rear leg member, and said second upper support bar is directed inwardly proximate its first end to engage said second front leg member.

12. The chair of claim 11 wherein said second end of said first lower support bar engages a forward surface of said first rear leg member, and said first lower support bar is directed inwardly proximate its first end to engage said first front leg member, and wherein said second end of said second lower support bar engages a forward surface of said second rear leg member, and said second lower support bar is directed inwardly proximate its first end to engage said second front leg member.

13. The chair of claim 12 wherein said first upper support member is mounted on said frame such that said first upper support member angles downwardly from said first end of said first upper support member to said second end of said first upper support member, and wherein said second upper support member is mounted on said frame such that said second upper support member angles downwardly from said first end of said second upper support member to said second end of said second upper support member.

14. A chair for supporting a second said chair in a stacked disposition, said chair comprising:

a frame defining at least first and second front leg members and first and second rear leg members, each said first and second front leg member and each said first and second rear leg member having a distal end for supporting said chair upon a supporting surface;

a seat portion supported on said frame; and a stacking support assembly for facilitating the stacking of said second said chair upon said chair, said stacking support assembly including a first upper support bar engagable with said second said chair to support said second said chair in a stacked disposition, said first upper support bar being mounted on a first side of said frame below said seat portion and above, and selectively spaced from, said distal end of said first front leg member and said distal end of said first rear leg member, said first upper support bar extending outwardly from a plane defined by said first front leg member and said first rear leg member, said stacking support assembly further including a second upper support bar engageable with said second said chair to support said second said chair in a stacked disposition, said second upper support bar being mounted on a second side of said frame below said seat portion and above, and selectively spaced from, said distal end of said second front leg member and said distal end of said second rear leg member, said second upper support bar extending outwardly from a plane defined by said second front leg member and said second rear leg member, said stacking support assembly further including a first lower support bar mounted on said first side of said frame below said first upper support bar and includes a second lower support bar mounted on said second side of said frame below said second upper support bar, each said first and second lower support bar defining a forward portion and a rearward portion, said first upper support bar defining a forward portion for supporting said forward portion of said first lower support bar of said second said chair and a rearward portion for engaging and supporting thereon said distal end of said first rear leg member of said second said chair, said second upper support bar defining a forward portion for supporting said forward portion of said second lower support bar of said second said chair and a rearward portion for engaging and supporting thereon said distal end of said second rear leg member of said second said chair, whereby said forward portions of said first and second lower support bars of said second said chair, and said distal ends of said first and second rear leg members of said second said chair, engage and support said second said chair upon said first and second upper support bars, respectively, of said chair when said second said chair is stacked upon said chair.

15. The chair of claim 14 wherein said first upper support bar is secured at a first end to said first front leg member and secured at a second end to said first rear leg member, and said second upper support bar is secured at a first end to said second front leg member and secured at a second end to said second rear leg member, and wherein said first lower support bar is secured at a first end to said first front leg member proximate said distal end of said first front leg member and secured at a second end to said first rear leg member proximate said distal end of said first rear leg member, and said second lower support bar is secured at a first end to said second front leg member proximate said distal end of said second front leg member and secured at a second end to said second rear leg member proximate said distal end of said second rear leg member.

16. The chair of claim 15 wherein said first and second front leg members are space apart a first distance and said first and second rear leg members are space apart a second distance, said second distance being greater than said first distance whereby said first and second front leg members of said chair can be received between said first and second rear leg members of said second said chair to facilitated the stacking of said second said chair upon said chair.

17. The chair of claim 16 wherein said second end of said first upper support bar engages a forward surface of said first rear leg member, and said first upper support bar is directed inwardly proximate its first end to engage said first front leg member, and wherein said second end of said second upper support bar engages a forward surface of said second rear leg member, and said second upper support bar is directed inwardly proximate its first end to engage said second front leg member.

18. The chair of claim 17 wherein said second end of said first lower support bar engages a forward surface of said first rear leg member, and said first lower support bar is directed inwardly proximate its first end to engage said first front leg member, and wherein said second end of said second lower support bar engages a forward surface of said second rear leg member, and said second lower support bar is directed inwardly proximate its first end to engage said second front leg member.

19. The chair of claim 18 wherein said first upper support member is mounted on said frame such that said first upper support member angles downwardly from said first end of said first upper support member to said second end of said first upper support member, and wherein said second upper support member is mounted on said frame such that said second upper support member angles downwardly from said first end of said second upper support member to said second end of said second upper support member.

* * * * *